US010475597B2

(12) United States Patent
Taborsky

(10) Patent No.: US 10,475,597 B2
(45) Date of Patent: Nov. 12, 2019

(54) EMERGENCY STOP DEVICE

(71) Applicant: Schneider Electric Industries SAS, Rueil Malmaison (FR)

(72) Inventor: Isabelle Taborsky, Barbezieux (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 41 days.

(21) Appl. No.: 15/957,978

(22) Filed: Apr. 20, 2018

(65) Prior Publication Data

US 2018/0323018 A1 Nov. 8, 2018

(30) Foreign Application Priority Data

May 2, 2017 (FR) ..... 17 53832

(51) Int. Cl.
*H01H 9/16* (2006.01)
*H01H 3/02* (2006.01)
(Continued)

(52) U.S. Cl.
CPC ..... *H01H 3/022* (2013.01); *G05G 1/015* (2013.01); *G05G 1/025* (2013.01); *G05G 5/04* (2013.01);
(Continued)

(58) Field of Classification Search
CPC .... H01H 11/0012; H01H 13/506; H01H 9/22; H01H 3/022; H01H 13/62; H01H 13/503;
(Continued)

(56) References Cited

U.S. PATENT DOCUMENTS 6,198,058 B1 * 3/2001 Graninger ..... H01H 13/02 200/16 R
6,376,785 B1 * 4/2002 Graninger ..... H01H 13/503 200/329

(Continued)

FOREIGN PATENT DOCUMENTS

EP 2 700 080 A1 2/2014
FR 2 792 453 A1 10/2000

OTHER PUBLICATIONS

French Preliminary Search Report dated Jan. 22, 2018 in French Application 17 53832, filed on May 2, 2017 (with English Translation of Categories of cited documents & Written Opinion).

*Primary Examiner* — Ahmed M Saeed
(74) *Attorney, Agent, or Firm* — Oblon, McClelland, Maier & Neustadt, L.L.P.

(57) ABSTRACT

An emergency stop device including a control button, an actuation assembly which includes an actuation plunger that cooperates with the control button and an actuation spring mounted between the body of the device and the actuation plunger, a trip plunger designed to cooperate with at least one electrical contact unit and one trip spring mounted between the actuation plunger and the trip plunger and arranged to actuate the trip plunger when the control button is actuated from its rest position to its actuated position, a latching member mounted on the trip plunger, an unlocking assembly including an unlocking ring that is arranged to cooperate with the control button to return it from its released actuated position to the rest position, the unlocking assembly including an unlocking spring mounted between the control button and the body, and arranged to actuate the control button towards its rest position.

12 Claims, 6 Drawing Sheets

(51) Int. Cl.

| | |
|---|---|
| ***G05G 1/02*** | (2006.01) |
| ***G05G 5/05*** | (2006.01) |
| ***G05G 1/015*** | (2008.04) |
| ***H01H 25/06*** | (2006.01) |
| ***G05G 5/04*** | (2006.01) |

(52) U.S. Cl.
CPC ..... *G05G 5/05* (2013.01); *H01H 9/16* (2013.01); *H01H 25/065* (2013.01); *H01H 2003/0246* (2013.01); *H01H 2219/036* (2013.01); *H01H 2219/0622* (2013.01); *H01H 2235/004* (2013.01)

(58) Field of Classification Search
CPC .. H01H 19/6355; H01H 1/2083; H01H 13/14; H01H 13/18; H01H 19/03; H01H 19/14; H01H 2221/036; H01H 9/16; H01H 25/065; H01H 2219/0622; H01H 2235/004; H01H 2003/0246; H01H 2219/036; G05G 1/015; G05G 5/05; G05G 1/025; G05G 5/04
USPC ..... 200/43.04, 43.07, 334, 341, 336, 50.02, 200/338
See application file for complete search history.

(56) References Cited

U.S. PATENT DOCUMENTS

| | | | | |
|---|---|---|---|---|
| 8,115,122 | B2 * | 2/2012 | Machida | H01H 3/022 200/16 A |
| 2002/0134656 | A1 | 9/2002 | Alain et al. | |
| 2005/0284742 | A1 * | 12/2005 | Ishii | H01H 3/001 200/341 |
| 2010/0243418 | A1 * | 9/2010 | Machida | H01H 3/022 200/341 |
| 2014/0042003 | A1 | 2/2014 | Meftah et al. | |
| 2016/0196933 | A1 * | 7/2016 | Wiese | H01H 3/022 200/341 |
| 2017/0213672 | A1 * | 7/2017 | Shimoyama | H01H 3/022 |

* cited by examiner

EMERGENCY STOP DEVICE

TECHNICAL FIELD OF THE INVENTION

The present invention relates to an emergency stop device, having in particular improved architecture and sealing.

PRIOR ART

Currently, a known emergency stop device such as described for example in document U.S. Pat. No. 7,790,996 comprises a control button that is mobile in translation between two positions along a control axis and is able to actuate a plunger which cooperates with an electrical contact unit. In order to unlock such emergency stop devices, the control button is actuated in rotation. In order to be easy to handle, the button must have a shape such that it can be easily gripped with respect to the rest of the device. It therefore often has a particularly proud shape, which increases its depthwise bulk.

Patent application. FR2792453A1 describes a conventional emergency stop device solution.

Patent EP2700080B1 describes a more compact emergency stop device. In this solution, the unlocking function is provided by a rotary ring that is independent of the button. Rotation of the ring serves to initiate unlocking in order to return the actuation button to the initial rest position. Return to the initial position is then provided by the spring (R1 in this document) which is also used to trip the device. Indeed, the function of tripping the device is provided by two springs (R1, R2) whose spring constants are matched to one another. The stiffness of the main spring (R1) must take into account the stiffness of the other spring (R2) and is chosen to be relatively low such that the emergency stop device has the desired sensitivity. Indeed, it cannot be increased without impairing the overall operation of the device. Indeed, increasing the stiffness of the spring R1, which would be desirable in order to improve the return of the button to its initial rest position, would however hamper the operation of the device in the trip phase. As a result, the solution described in this patent EP2700080B1 retains certain drawbacks.

The object of the invention is therefore to propose an emergency stop device in which the unlocking operation for returning the control button to the initial rest position is particularly reliable and is implemented without impairing the trip function.

The solution of the invention also makes it possible to overcome certain other drawbacks of prior devices, in particular in terms of sealing of the device.

SUMMARY OF THE INVENTION

This object is achieved with an emergency stop device comprising:

- a body,
- a control assembly comprising a control button that is mobile in translation along a control axis between a rest position and an actuated position,
- an actuation assembly which comprises:
  - an actuation plunger that cooperates with said control button and an actuation spring mounted between said body and said actuation plunger,
  - a trip plunger designed to cooperate with at least one electrical contact unit and one trip spring mounted between said actuation plunger and said trip plunger and arranged to actuate said trip plunger when the control button is actuated from its rest position to its actuated position,
  - a latching member mounted on the trip plunger and mobile between:
    - a latching position in which it cooperates with a stop of the body to lock the trip plunger in an actuated position and lock the actuation plunger and the control button, which are as one with the trip plunger, into a released actuated position, and
    - a retracted position in which it is freed from said stop to allow the trip plunger to return to a rest position,
- an unlocking assembly comprising an unlocking ring that can be actuated in rotation about said control axis and is arranged to cooperate with said control button to return it from its released actuated position to the rest position,
- the unlocking assembly comprising an unlocking spring mounted between the control button and the body, and arranged to actuate said control button towards its rest position.

According, to one particular feature of the device, the body comprises an inner housing bearing the actuation assembly and an outer housing bearing the unlocking assembly.

According to another particular feature, the outer housing is in the shape of a crown having a tubular portion on which said unlocking ring is mounted.

According to another particular feature, said control button is mounted so as to be able to slide in said tubular portion of the outer housing, and the device comprises a first seal arranged between said control button and said outer housing.

According to another particular feature, the inner housing comprises a widened upper portion and a lower portion.

According to another particular feature, the actuation plunger is mounted so as to be able to slide in said upper portion of the inner housing, and the device comprises a second seal arranged between said actuation plunger and said inner housing.

According to another particular feature, the actuation plunger is secured to said control button.

According to another particular feature, the trip plunger is fitted onto the actuation plunger by a rail-type mechanical connection.

According to another particular feature, the device comprises a printed circuit accommodated in said outer housing.

According to another particular feature, the device comprises a light-producing assembly connected to said printed circuit.

According to another particular feature, the device comprises a latching member that is mounted on the trip plunger and is mobile between a latching position in which it cooperates with a stop of the body in order to lock the trip plunger in an actuated position, and a retracted position in which it is freed from said stop to allow the trip plunger to return to a rest position.

According to another particular feature, the device comprises an electrical contact assembly arranged to cooperate with said trip plunger.

BRIEF DESCRIPTION OF THE FIGURES

Other features and advantages will appear in the following detailed description given with regard to the appended drawings, in which.

DETAILED DESCRIPTION OF AT LEAST ONE EMBODIMENT

Figure 1:
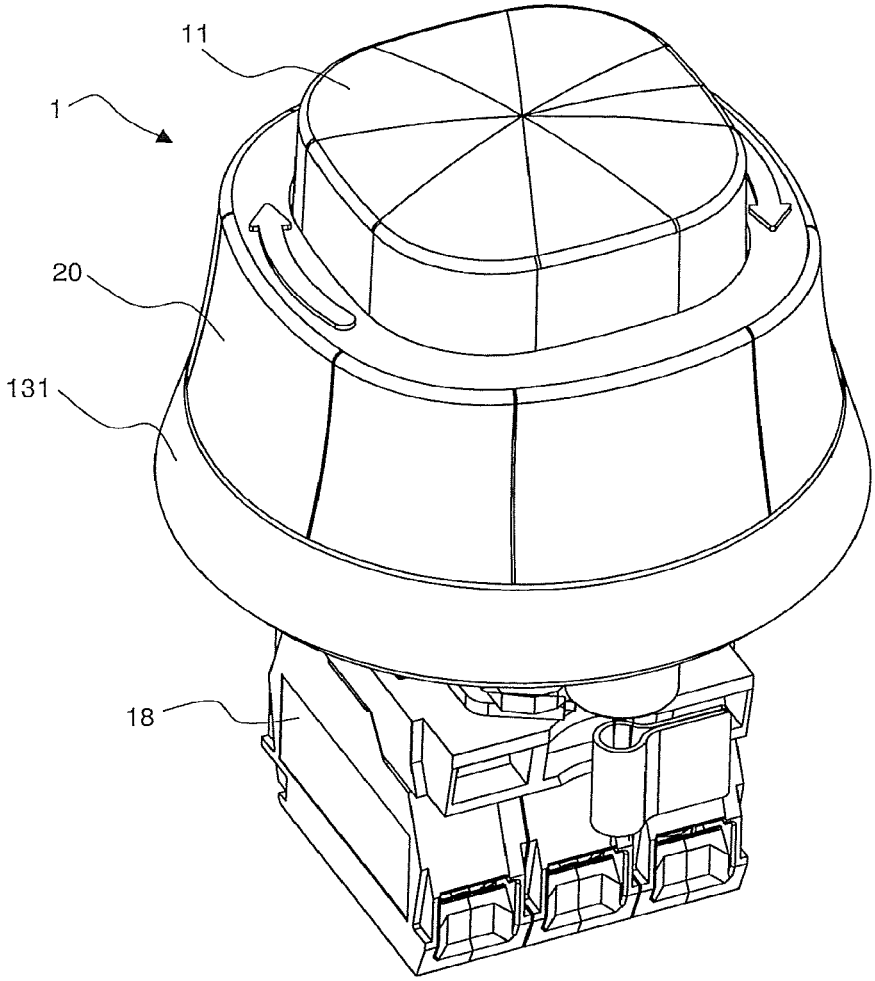
FIG. 1 shows a perspective view of the emergency stop device of the invention in the initial rest position.
Figure 2:
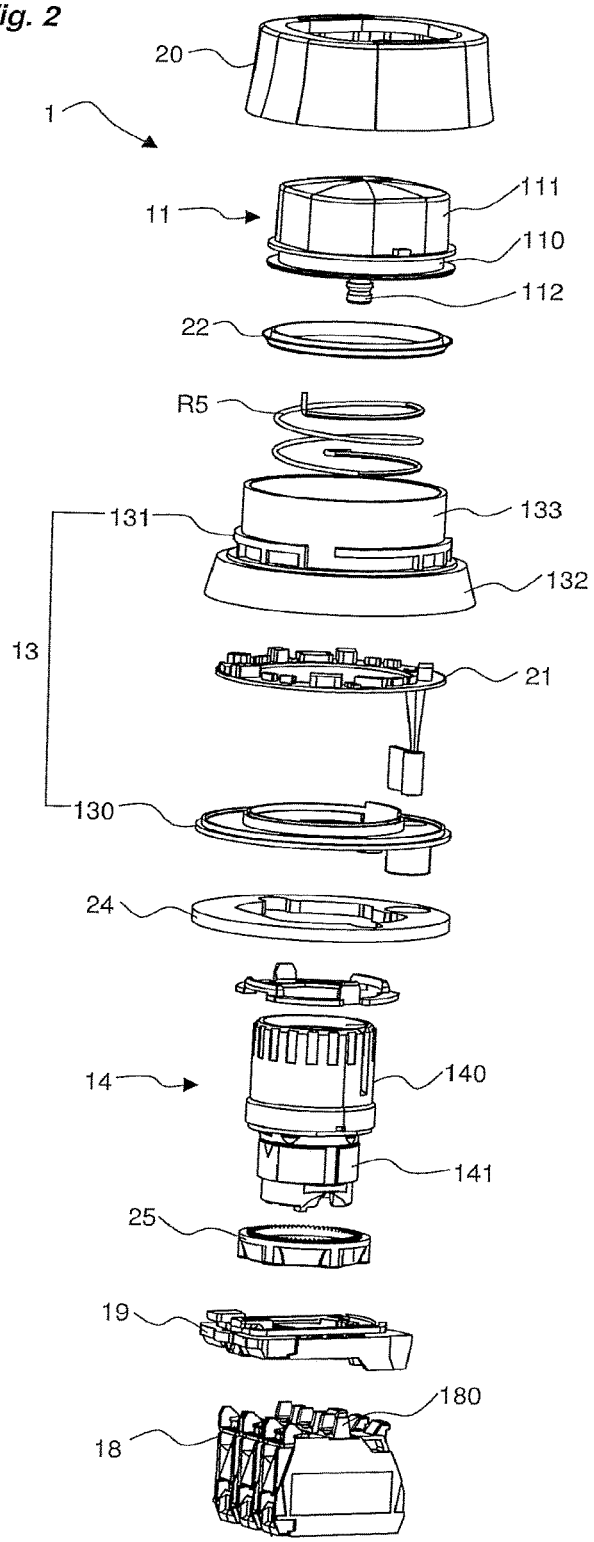
FIG. 2 shows an exploded view of the emergency stop device of the invention.

As is known, an emergency stop device 1 is designed to control an electric circuit and can be actuated by an operator in order to open the electric circuit in the event of an emergency.

The emergency stop device 1 of the invention can be mounted via an opening of standard diameter (for example a diameter of 22 mm or 30 mm) created in a wall or in a flush-mounted box that is secured to the wall or is flush-mounted in the wall. As is conventional, a securing ring 25 is for example used to secure the device to the wall. The front side of the wall is defined as that side from which the control button is accessible, and the rear side of the wall as that side on which is placed the electrical contact assembly.

In the rest of the description and in the appended drawings, we define a control axis (X) along which the mobile portions of the device 1 are actuated in translation. The terms "upper", "lower", "top" or "bottom" are to be understood as being with reference to the control axis (X) in a vertical direction.

The rest of the description defines three distinct positions or states of the device. These three positions apply to all of the mobile elements of the emergency stop device described hereinbelow. These three positions are as follows:

- a rest position in which the various mobile elements are in the rest state, that is to say prior to actuation of the device;
- an actuated position obtained after actuation of the device; actuation is then effected until the control button arrives at the stop;
- a released actuated position obtained after actuation of the device and release of the control button; the device must be unlocked to leave this position.

The emergency stop device of the invention comprises multiple functional assemblies:

- a control assembly;
- an actuation assembly;
- an unlocking assembly;
- an electrical contact assembly.

The emergency stop device of the invention comprises a body. Hereinafter, it will be assumed that all parts of the device that are fixed during operation of the device are part of the body. The body advantageously comprises an inner housing 14 on which is in particular fitted the actuation assembly, and an outer housing 13 fitted on the inner housing and on which is in particular fitted the unlocking assembly. The outer housing 13 is for example in the general shape of a crown comprising a base 130 and a hood 131. Said hood 131 advantageously comprises a lower crown 132 and a tubular portion 133 extending above the crown 132. The inner housing is in turn in the form of an independent block that is inserted axially into the axial space created at the centre of the crown.

The inner housing 14 comprises a widened upper portion 140 defining a collar and a lower portion 141, which are separated from one another by a shoulder. It also comprises an axial opening over its entire height and an inner sleeve 142 defining a trough 143 with its collar. The inner housing means that the actuation assembly advantageously has a monolithic, that is to say one-piece, structure. Thus, the actuation assembly can easily be replaced without having to touch the rest of the device 1, in particular the assemblies accommodated in the outer housing 13.

According to one particular aspect of the invention, once the device has been mounted on a wall, the architecture of the device is such that:

- the outer housing 13 is located on the front side with respect to the wall;
- the lower portion 141 of the inner housing 14 is inserted through the standard opening created in the wall, such that its shoulder comes to bear against the wall, at the periphery of the opening, on the front side of the wall;
- the securing ring is positioned on the lower portion of the inner housing so that the device is secured and locked on the rear side of the wall.

The control assembly of the emergency stop device comprises a control button 11 that is mounted so as to slide in the tubular portion 133 of the outer housing 13 of the body, such that it can be actuated in translation with respect to the body of the device along said control axis (X). The control button 11 is initially in a rest position in which the electric circuit that is controlled is closed. When subject to pressure towards the interior of the device, the control button 11 slides in the tubular portion 133 so as to arrive at an actuated position in which it abuts against the body of the device, such that the electric circuit can then be opened in a positive manner. After actuation, the control button 11 is released but then remains latched in a position referred to as the released actuated position, in which the electric circuit remains open. The electric circuit remains open until the device is unlocked.

The control button 11 advantageously comprises a head 111, on which pressure can be applied in order to actuate the device, and a stem 112 that extends in an axial direction towards the interior of the device and is designed to cooperate with the actuation assembly of the device. The head of the device advantageously has a non-circular cross section, by virtue of which it can cooperate in rotation with the unlocking ring 20.

Figure 3A:
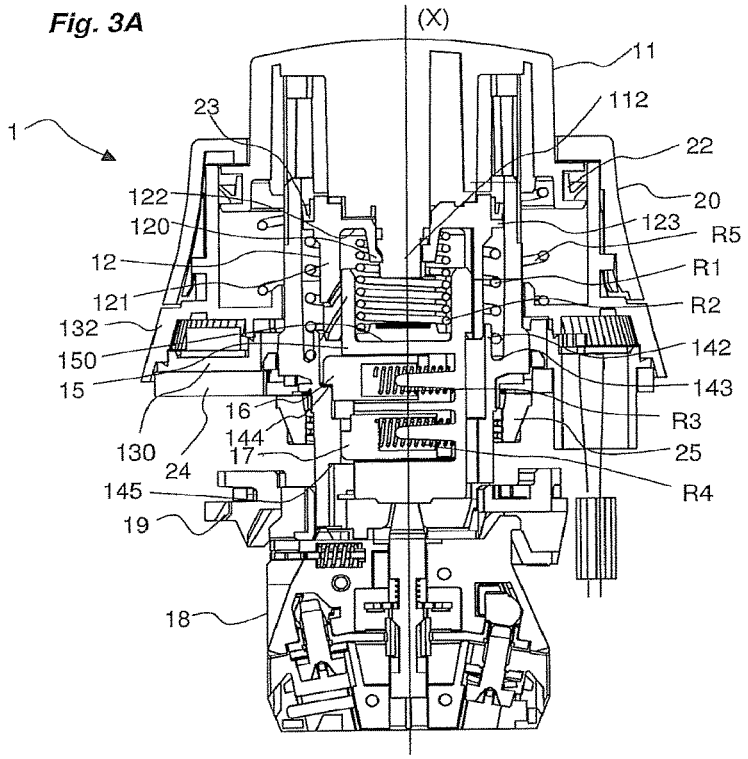
FIGS. 3A and 3B show, along two axial transverse sections, the emergency stop device of the invention in the rest position.
Figure 3B:
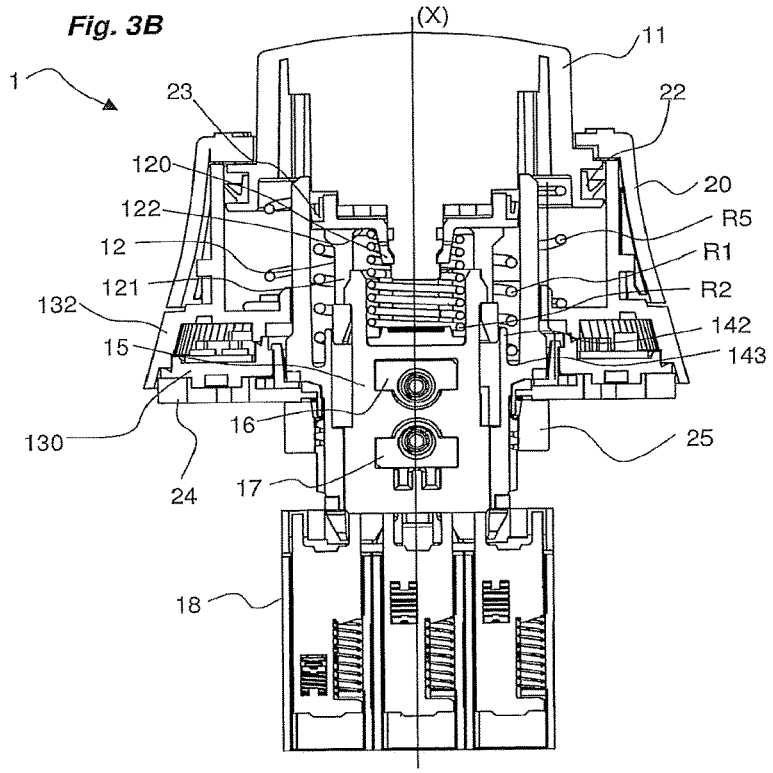

With reference to FIGS. 3A and 3B, the actuation assembly comprises an actuation plunger 12 that is latched to the control button 11 by means of securing members created both on the control button 11 and the actuation plunger. These securing members are for example snap-fitting members by which the actuation plunger can be snapped-fitted onto the stem 112 of the control button 11.

The actuation plunger 12 is mounted so as to slide in the collar of the inner housing 14. The actuation plunger 12 is in the form of a cylindrical part comprising an inner sleeve 120 and an outer sleeve 121 which form a trough 122 between them. The actuation plunger 12 also comprises a collar 123 created on its outer sleeve.

The actuation assembly comprises an actuation spring R1 that presses at one end against the bottom of the trough 143 of the inner housing and at the other end against the collar 123 of the actuation plunger 12, such that the actuation plunger 12 is mounted on this actuation spring R1.

The actuation assembly also comprises a trip plunger 15. This trip plunger 15 is in the form of a bushing which is latched onto the actuation plunger 12 while retaining a degree of freedom in translation in the axial direction with respect to the actuation plunger 12, between two stop positions. The actuation assembly comprises a trip spring R2 that presses at one end against the bottom of the trough 122 of the actuation plunger 12 and at the other end against the bottom 150 of the bushing formed by the trip plunger 15.

The actuation assembly also comprises a trip member 16 and a latching member 17, which each consist for example of a pin that is received in a radial recess created in the trip plunger 15. Each of these two members is mounted on a separate coil spring R3, R4 so as to be able to move radially with respect to the control axis (X). The trip member 16 and the latching member 17 are positioned so as to each cooperate with the inner housing depending on the position of the trip plunger 15. The trip member 16 and the latching member 17 are able to move in two different, parallel planes that are perpendicular to the control axis (X). The plane of translation of the trip member 16 is located above the plane of translation of the latching member 17. On the inner surface of its central opening, the inner housing comprises cam shapes designed to be followed by the trip member 16 and the latching member 17, such that each of these members can carry out its function.

The trip member 16 is in abutment against a stop 144 of the inner housing in order to prevent the trip plunger 15 from moving downwards and in order to hold it in the rest position until sufficient energy is stored in the actuation spring R1. When the control button 11 is sufficiently depressed, the action of a cam shape created on the body causes the trip member 16 to retract into its recess, unlocking the trip plunger 15. Under the action of the trip spring R2, the trip plunger 15 is driven in translation downwards. After tripping, the mechanical connections existing on one hand between the trip plunger 15 and the actuation plunger 12, and on the other hand between the actuation plunger 12 and the control button 11 mean that the control button 11 is held in the released actuated position towards the interior of the body. The latching member 17 cooperates with a stop 145 created on the inner housing such that the trip plunger 15 can latch onto the body when the control button 11 is depressed into its actuated position, and thus to hold/lock the actuation plunger 12 and the control button 11 in the released actuated position.

The electrical contact assembly advantageously comprises at least one electrical contact unit 18, generally at least two electrical contact units in order to provide redundancy upon actuation of the device. Each electrical contact unit 18 comprises a set of normally closed (NC) electrical contacts. Each contact unit 18 comprises, for example, a plunger 180 that is as one with a bridge of movable contacts which is designed to be actuated axially by the stem of the trip plunger. The contact units are for example secured to a base 19 fitted onto the body of the device, more precisely directly onto the lower portion 141 of the inner housing. Since these features are conventional in the field of industrial button devices, they are not described in the present patent application.

The unlocking assembly comprises an unlocking ring 20 that is distinct from the control button 11 and is mounted mobile in rotation on the outer housing 13 of the body, more precisely on the tubular portion 133 of the hood of the outer housing. The unlocking ring 20 is arranged at the periphery of the control button 11 and cooperates in rotation with the control button 11 so as to unlock the latter. Driving means are arranged between the ring and the control button such that the control button 11 is driven by the unlocking ring 20 when the ring is actuated in rotation. These driving means are created for example by the external shape of the cross section of the control button 11 and the internal shape of the cross section of the unlocking ring 20. In the appended figures, the cross section of the control button is essentially square (with rounded corners) and the internal shape of the cross section of the ring matches the contour resulting from this square shape.

According to one particular aspect of the invention, in addition to the actuation spring R1 and the trip spring R2, the unlocking assembly comprises a specific spring R5 that is arranged so as to drive the control button towards its initial rest position. This unlocking spring R5 is advantageously accommodated in the outer housing 13 of the body and is guided by the wall formed by the collar located in the upper portion of the inner housing. It has one end attached to the control button 11 and another end attached to the bottom of the outer housing 13. It is advantageously prestressed between its two ends, in translation in the axial direction and in torsion about this axial direction so as to also return the ring to its initial position after rotation.

When the unlocking ring 20 is rotated, it drives in rotation the control button 11, which drives in rotation the actuation plunger 12, then the trip plunger. The rotation of the trip plunger 15 frees the latching member 17 from the stop created on the body, and makes it possible to free the control button 11 which, under the action of the unlocking spring R5, is then returned towards its rest position. Since the unlocking spring R5 is prestressed in torsion and in compression, the return of the control button 11 to its initial position follows a trajectory of translation combined with a rotation.

By using an unlocking ring 20 that is distinct from the control button 11 it is possible to propose a device having a particularly compact architecture.

According to another particularly advantageous aspect of the invention, it is understood that the three springs R1, R2, R5 are mounted in spaces arranged concentrically around the control axis (X). The spring R2 is located closest to the control axis, the spring R1 is mounted at the periphery of the spring R2 and the spring R5 is mounted at the periphery of the spring R1. In particular, this arrangement improves compactness in the height direction.

Of course, the two springs R1 and R2 must be chosen and suitable for tripping the device when a certain pressure is exerted on the control button. For its part, the spring R5 will be chosen so as to return the control button to the initial position, independently of the choice of the two springs R1 and R2. Thus, the unlocking function will be entirely independent of the function of tripping the device.

Advantageously, the emergency stop device comprises a light-producing assembly that is entirely integrated within the device and is fitted to a printed circuit 21 accommodated in the outer housing 13. This light-producing assembly is designed to act as a luminous signal of the emergency stop device. This light-producing assembly comprises, for example, one or more light-emitting diodes soldered to the printed circuit 21 and connected to power supply blocks. For example, the light-producing assembly is made to light up the emergency stop device in yellow or in red depending on the functional state of the latter. The hood 131 of the outer housing 13 may have a transparent crown 132 allowing the light from the diodes to escape. Since this light-producing assembly is accommodated in the outer housing, its operation will not disrupt the operation of the actuation assembly. The power supply blocks for the light-emitting diodes are for example placed on the rear side of the wall and are connected to the diodes by wires passing for example through a hole adjacent to the opening for securing the device, or through the opening for securing the device 1 if this opening is of a suitable size to allow the power supply wires to pass through.

According to one particularly advantageous aspect of the invention, the very distinct separation between the actuation function, and the unlocking function makes it possible to propose a particularly effective sealing solution. The outer housing 13 comprises a first sealing solution and the inner housing 14 comprises a second sealing solution.

The first sealing solution comprises in particular a lip seal 22 arranged in a channel 110 created on the lateral flank of the control button 11. This lip seal is designed to rub against the internal wall of the tubular portion 133 of the hood 131 of the outer housing 13. It can thus ensure leak-tightness as the control button slides. Furthermore, the presence of the dedicated unlocking spring R5 makes it possible to ensure that the control button returns to its rest position in spite of the friction of the lip seal during operation.

The second sealing solution comprises, in particular, a lip seal 23 arranged between the actuation plunger 12 and the inner housing 14. This lip seal 23 is positioned such that it bears against the collar 123 of the actuation plunger 12, on the bearing face opposite that of the actuation spring. This lip seal makes it possible to protect the volume enclosed by the inner housing 14 of the device from any ingress of dust or liquid, ensuring always reliable operation of the actuation assembly.

An additional seal 24, of annular shape, is also positioned beneath the base 130 of the outer housing.

Figure 4A:
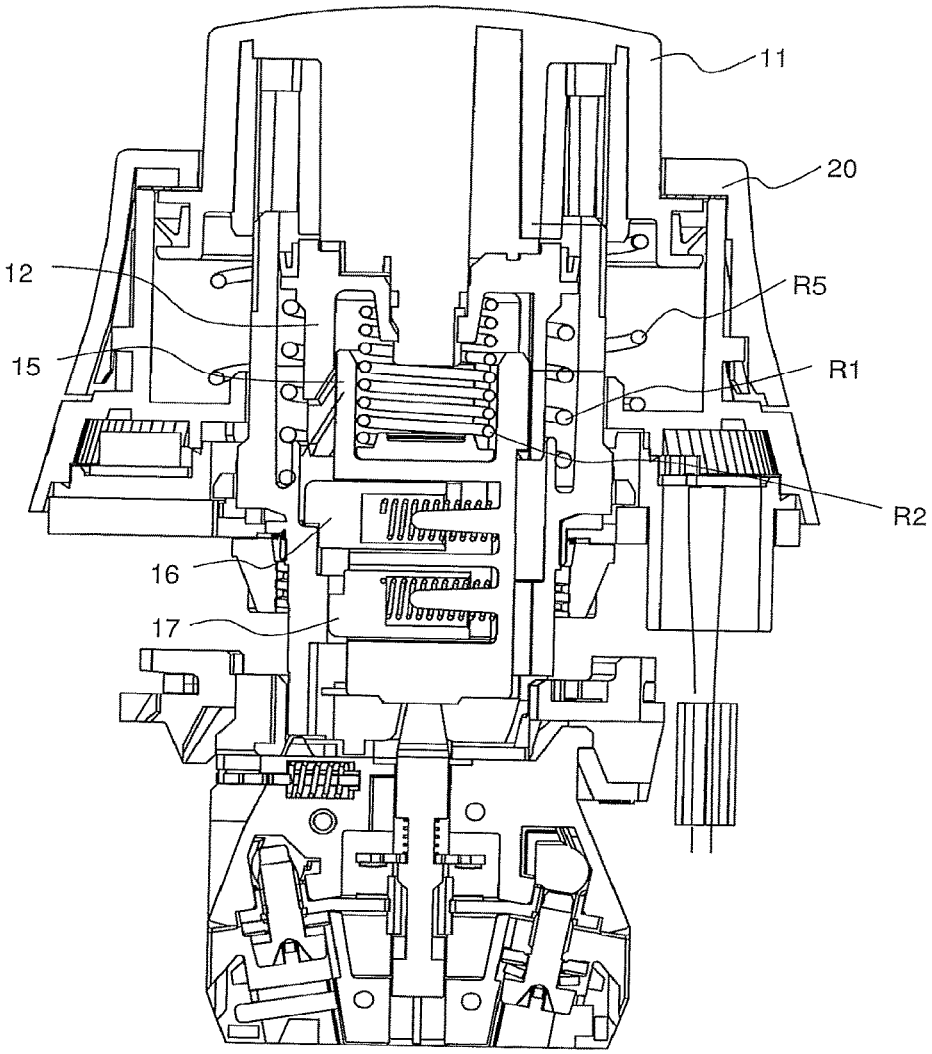
FIGS. 4A to 4C show, by way of views in transverse axial section, the operating principle of the emergency stop device of the invention, respectively in the rest position, in the actuated position and in the released actuated position.

With reference to the appended figures, the operation of the emergency stop device of the invention follows the various successive phases listed below:

Rest Position—FIG. 4A

The device is in the rest position;

The control button 11 is in the upper position;

The device is for example illuminated in a first colour indicating its functional state.

Actuation

The control button 11 is pressed as far as the stop in the axial direction (X);

The actuation plunger 12, as one with the control button 11, is driven in translation in the axial direction (X);

The compression of the actuation spring R1 is sufficient to trip the device 1;

The trip member 16 retracts into its recess;

The trip plunger 15 is freed from its stop formed by the trip member 16 against the body;

The trip spring R2 relaxes between the actuation plunger 12 and the trip plunger 15;

The trip plunger 15 is driven in axial translation by the trip spring R2;

At the end of its travel, the trip plunger 15 acts on the contact assembly 18.

Figure 4B:
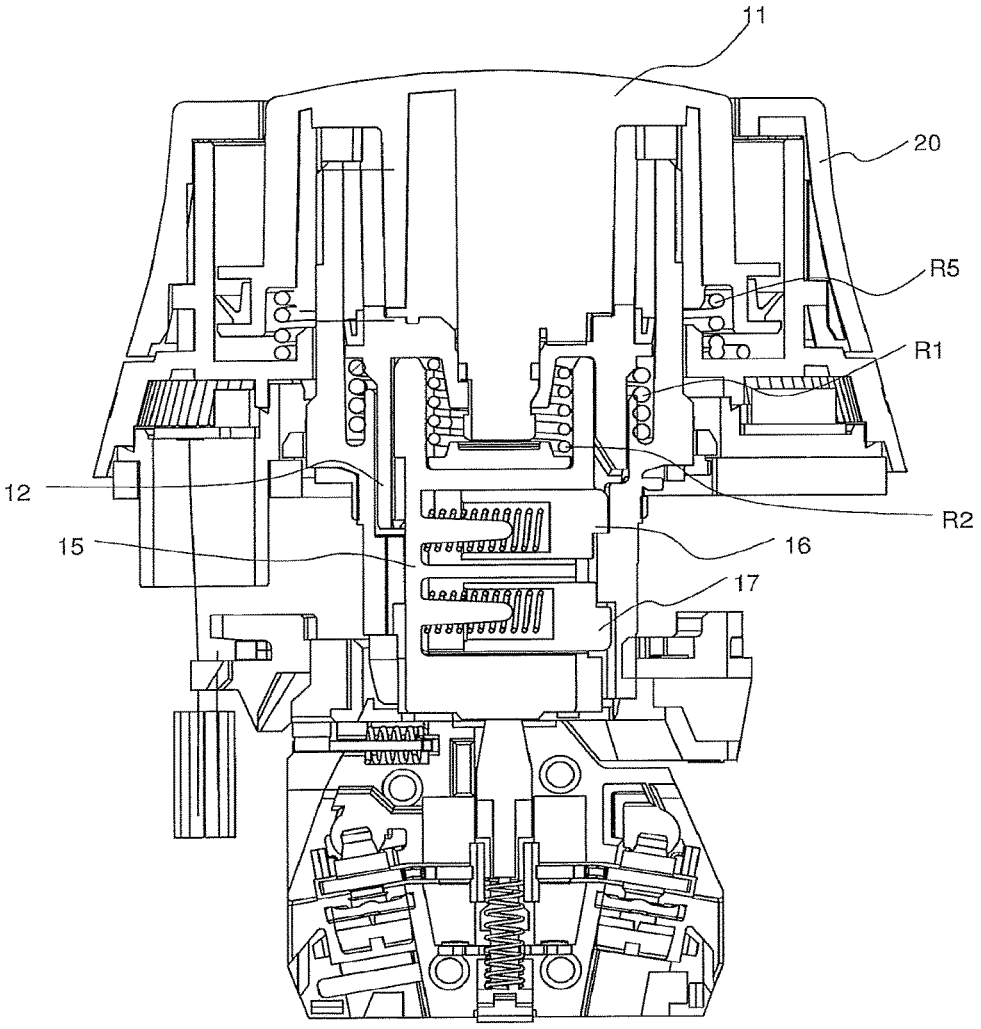

Actuated Position—FIG. 4B

The control button 11 is in abutment;

The trip plunger 15 is in the lower position;

The latching member 17 is freed from its recess under the action of its spring;

The actuation spring R1 is compressed between the body and the actuation plunger 12;

The trip spring R2 is compressed between the actuation plunger 12 and the trip plunger 15;

The device is for example illuminated in a second colour indicating its new functional state.

Figure 4C:
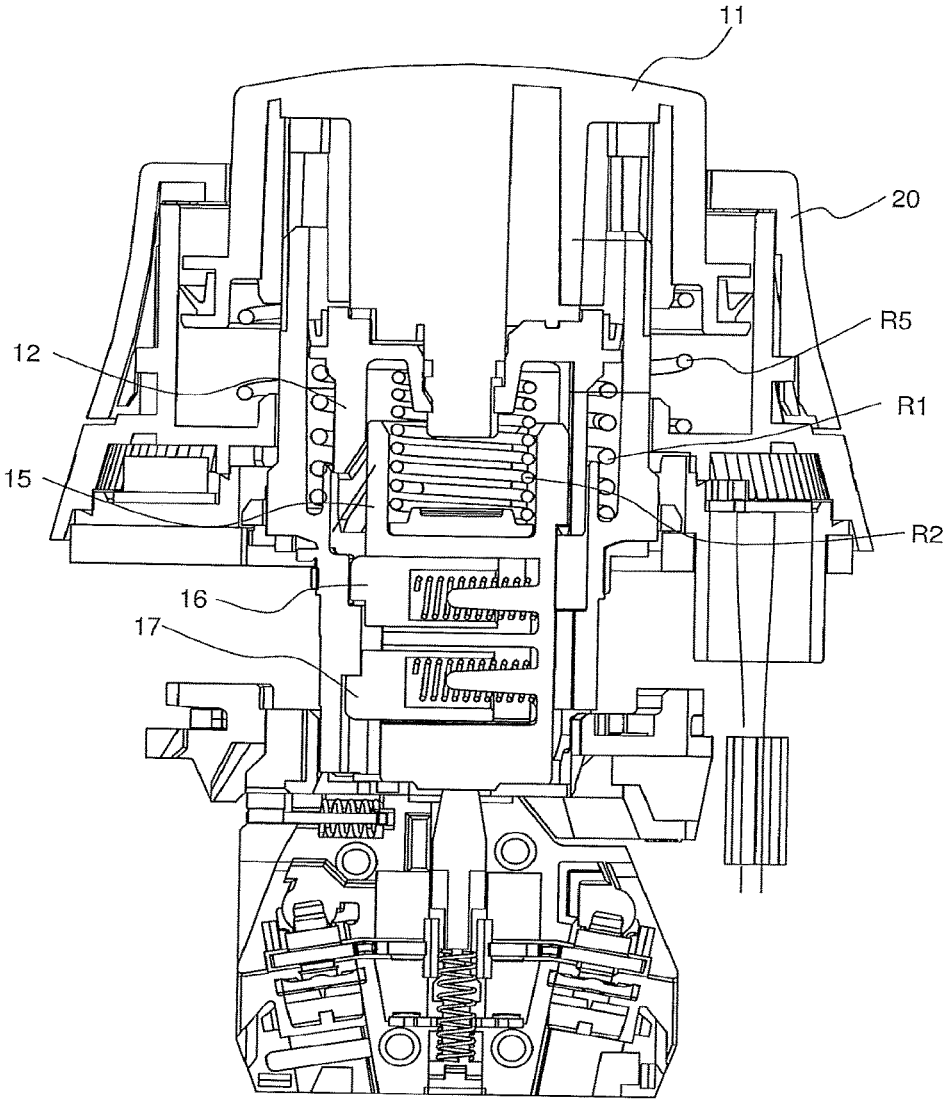

Released Actuated Position—FIG. 4C

The control button 11 is released;

The latching member 17 comes to cooperate with the stop 145 of the body of the device;

The trip plunger 15 is held in the lower position by the latching member 17;

The actuation plunger 12 and the control button 11, as one with the trip plunger 15, are retained in the released actuated position;

The actuation spring R1 remains stressed;

The trip spring R2 is released;

The device remains illuminated in the second colour indicating its functional state.

Unlocking Phase

The unlocking ring 20 is actuated in rotation;

As it rotates, the unlocking ring 20 drives the control button 11;

As it rotates, the control button 11 drives in rotation the actuation plunger 12 and the trip plunger 15;

The rotation of the trip plunger 15 causes the latching member 17 to return to its recess, by following the cam shapes created on the body;

The trip plunger 15 is freed from its latched position and thus frees in translation the actuation plunger 12 and the control button 11;

The control button 11, once again free in translation, is returned to the rest position by the unlocking spring R5;

The unlocking spring relaxes in torsion and in translation, driving the control button in the same torsion/translation movement;

The device has returned to its initial rest position;

The device is once more illuminated in the first colour.

It will be understood from the above description that the device of the invention has certain advantages, including:

Complete independence between the actuation/trip function and the unlocking function, by virtue in particular of the use of a separate spring R5 dedicated to unlocking;

The possibility of adjusting the force of the various springs independently for the actuation/trip function (springs R1 and R2) and for the unlocking function (R5);

The independence between the actuation/trip function and the unlocking function makes it possible to propose an architecture having two very distinct housings, the inner housing and the outer housing;

The independence between the actuation/trip function and the unlocking function makes it possible to propose an architecture in which the sealing solutions used are very distinct, making it possible in particular to protect the actuation/trip function vis-á-vis the unlocking function;

The possibility of proposing, simply and reliably, a device having a light-producing signalling function;

The architecture of the device also makes it possible to perform what is referred to as the non-obstruction function, that is to say that it avoids devices positioned on the same wall in any way obstructing the proper operation of the device.

The invention claimed is:

1. An emergency stop device comprising:

a body, a control assembly comprising a control button that is mobile in translation along a control axis between a rest position and an actuated position, an actuation assembly which comprises:

an actuation plunger that cooperates with said control button and an actuation spring mounted between said body and said actuation plunger, a trip plunger designed to cooperate with at least one electrical contact unit and one trip spring mounted between said actuation plunger and said trip plunger and arranged to actuate said trip plunger when the control button is actuated from its rest position to its actuated position, a latching member mounted on the trip plunger and mobile between:

a latching position in which it cooperates with a stop of the body to lock the trip plunger in an actuated position and lock the actuation plunger and the control button, which are as one with the trip plunger, into a released actuated position, and a retracted position in which it is freed from said stop to allow the trip plunger to return to a rest position, an unlocking assembly comprising an unlocking ring that can be actuated in rotation about said control axis and is arranged to cooperate with said control button to return it from its released actuated position to the rest position, wherein the unlocking assembly comprises an unlocking spring mounted between the control button and the body, and arranged to actuate said control button towards its rest position.

2. The device according to claim 1, wherein the body comprises an inner housing bearing the actuation assembly and an outer housing bearing the unlocking assembly.

3. The device according to claim 2, wherein the outer housing is in the shape of a crown having a tubular portion on which said unlocking ring is mounted.

4. The device according to claim 3, wherein said control button is mounted so as to be able to slide in said tubular portion of the outer housing, and wherein the device comprises a first seal arranged between said control button and said outer housing.

5. The device according to claim 2, wherein the inner housing comprises a widened upper portion and a lower portion.

6. The device according to claim 5, wherein the actuation plunger is mounted so as to be able to slide in said upper portion of the inner housing, and wherein the device comprises a second seal arranged between said actuation plunger and said inner housing.

7. The device according to claim 2, wherein the actuation plunger is secured to said control button.

8. The device according to claim 7, wherein the trip plunger is fitted onto the actuation plunger by a rail-type mechanical connection.

9. The device according to claim 2, comprising a printed circuit accommodated in said outer housing.

10. The device according to claim 9, comprising a light-producing assembly connected to said printed circuit.

11. The device according to claim 1, wherein the actuation assembly comprises a trip member that is mounted on the trip plunger and is mobile between a locking position in which said trip member cooperates with a stop of the body in order to prevent the trip plunger from moving from a rest position to an actuated position, and a retracted position in which said trip member is freed from said stop to allow the trip plunger to be tripped to said actuated position.

12. The device according to claim 1, comprising an electrical contact assembly arranged to cooperate with said trip plunger.

* * * * *